United States Patent [19]

Roberts et al.

[11] 4,418,507

[45] Dec. 6, 1983

[54] INTERIOR WALL SYSTEM

[76] Inventors: Frank W. Roberts, 380 E. 7500 South, Midvale, Utah 84047; Richard A. Roberts, 4973 Regency; W. Calvin Roberts, 4906 Regency, both of Holladay, Utah 84117; Jack A. Nipko, 13735 Shadow Mountain La., Draper, Utah 84020; Clark S. Roberts, 4906 Regency, Holladay, Utah 84117; Hal R. Hudson, 759 S. 300 West, Orem, Utah 84057

[21] Appl. No.: 278,951

[22] Filed: Jun. 30, 1981

[51] Int. Cl.[3] ..... E04B 2/30

[52] U.S. Cl. ..... 52/241; 52/309.11; 52/481; 52/489; 52/774; 52/713

[58] Field of Search ..... 52/241, 281, 309.11, 52/309.12, 481, 489, 772, 774, 345, 353, 357, 358, 362, 712, 713, 715

[56] References Cited

U.S. PATENT DOCUMENTS

| | | | |
|---|---|---|---|
| 1,589,716 | 6/1926 | Peters | 52/362 |
| 1,831,163 | 11/1931 | Crowell | 52/353 |
| 1,871,196 | 8/1932 | Pitcher | 52/353 |
| 1,982,892 | 12/1934 | Venzie | 52/357 |
| 1,994,776 | 3/1935 | Wread | 52/213 |
| 2,089,942 | 8/1937 | Barson | 52/489 |
| 3,325,198 | 6/1967 | Crase | 52/713 |
| 3,327,441 | 6/1967 | Kelly | 52/309.11 |
| 3,339,324 | 9/1967 | Stackhouse | 52/241 |
| 3,383,817 | 5/1968 | Gregori | 52/309.11 |
| 3,415,026 | 12/1968 | Tillisch | 52/241 |
| 3,453,790 | 7/1969 | Harris | 52/241 |

FOREIGN PATENT DOCUMENTS

| | | | |
|---|---|---|---|
| 263383 | 6/1963 | Australia | 52/281 |

*Primary Examiner*—Henry E. Raduazo

*Attorney, Agent, or Firm*—H. Ross Workman; Rick D. Nydegger; Dale E. Hulse

[57] ABSTRACT

An interior wall system formed from two opposing walls. Each opposing wall is assembled from a plurality of composite wall panels, each wall panel having an exterior surface material and an interior layer of insulating material bonded to one side of the exterior surface material. Each opposing wall is anchored to top and bottom U-shaped support members and adjoining wall panels of each wall are connected by a plurality of retaining clips. The retaining clips may be adjusted in length to accommodate various widths between the opposing walls. Additionally, splines are inserted between the first and second walls along the seams between adjoining wall panels. The wall system also includes a door frame comprising first and second jamb members and a lintel member, each having a spacing member attached to approximately the center thereof. The spacing members are inserted between the opposing walls and are used to anchor the door frame in place.

14 Claims, 9 Drawing Figures

INTERIOR WALL SYSTEM

BACKGROUND

1. Field of the Invention

The present invention relates to interior wall systems used to partition large rooms into smaller offices and storage rooms.

2. The Prior Art

Most large office buildings are typically erected with only the exterior and a few load bearing interior walls being completed. The additional interior walls are later added depending on the needs of the occupants. One such interior wall system is disclosed in Belgian Pat. No. 511,174. This system utilizes top and bottom metal rails onto which longitudinal metal support members are bolted. Wall panels are attached to the support members by inserting T-shaped clamps between adjoining panels, the clamps being anchored in a groove in the support members. This system is time-consuming to install because the members making up the framing structure are complex in comparison with other systems, thus also increasing the cost of this system.

Another type of known interior wall system comprises a framing structure of U-shaped channel members into which prefinished wall panels are inserted. This system requires that the U channels be made of heavy gauge metal to prevent the side flanges of the U channels from deforming which would allow the wall panels to fall out. Also, this type of interior wall system typically does not adequately keep out noise from one room to the next, nor is it very sturdy.

Interior walls can also be constructed according to conventional techniques wherein wooden or metal studs extend from floor to ceiling at regularly spaced intervals. Wall panels are then nailed or screwed to the studs. This type of construction requires additional work to cover the holes created by the nails to achieve a finished look. This finishing requires considerable time and therefore, considerable expense. Additionally, this type of wall cannot be taken down or moved without severely damaging the materials used to construct the walls.

Other problems are also associated with the currently known types of systems for constructing interior walls. For example, the spacing between opposing walls is not readily variable in any of the systems. It is often advantageous to increase the spacing between the sides of the walls to accommodate pipes, wires, or other features. Moreover, most of the prior art systems that can be easily taken down and moved do not provide walls having an adequate sound barrier, or which are very sturdy.

It would therefore be a significant advancement in the art to provide an interior wall system which can be easily and inexpensively assembled, which is sturdy and which provides an adequate sound barrier. It would be a further advancement in the art to provide an interior wall system in which the space between opposing walls can easily be adjusted to accommodate pipes and wires which must be concealed within the wall.

BRIEF SUMMARY AND OBJECTS OF THE INVENTION

The present invention relates to a novel interior wall system which is relatively easy and inexpensive to assemble. The spacing between opposing sides of the wall can easily be adjusted to allow for pipes and wires which must be concealed in the wall. The invention also utilizes a novel door frame which is quickly assembled and is easier to install than conventional prehung doors.

According to the present invention, lightweight metal U channels are attached to the floor and to the ceiling structure. Opposing walls are then built along both sides of the U channels. Each wall is constructed from a plurality of composite wall panels comprising an exterior surface material with a layer of foamed plastic insulating material adhered to a face thereof. The wall panels are attached to the metal U channels by inserting screws through the wall panels and into the channels. Special retaining clips which hold adjacent and opposing wall panels in spaced relationship to each other are then attached to the wall panels by inserting flanges extending from the body of the clip into the wall panel beween the exterior surface material and the layer of foamed plastic insulating material. A second wall panel is then positioned adjacent the first wall panel with the flanges extending from the retaining clips are inserted between the exterior surface material and the foamed plastic insulating material of the second, adjoining wall panel.

A spline member is then inserted over the body of the retaining clips. The spline member spans the seam between adjacent wall panel members and acts as an additional barrier to light and noise, preventing their passage through the wall. The spline also provides additional support to the assembled wall panels. Once the wall panels on one side of the U channel are assembled, wall panels are then assembled on the opposite side of the U channel in a similar manner.

The interior wall system of the present invention also includes a novel system and method of door frame construction. An opening for a door is cut in the wall panels. Each of the jamb members of the door frame comprises a wooden plate with a spacing member attached to the center of one side of the plate. The door frame is installed by inserting the spacing member of one of the jambs into the space between opposing wall panels forming one edge of the door opening. The jamb is then squared with the floor and screws are inserted through the wall panels into the spacing member to anchor it in place. The lintel or top plate is then installed by inserting one end of the lintel above the top edge of the installed door jamb and sliding the spacing member of the lintel into the space between the wall panels, forming the top portion of the door opening. The lintel is then squared with the installed door jamb and screws are inserted through the wall panels into the spacing member. The second door jamb is then installed by positioning the top of the jamb below the opposite end of the lintel and inserting the spacing member into the space between the wall panels, forming the other side of the door opening. Finally, when this jamb member is squared, screws are inserted through the wall panels into the spacing member. The structure and method of securing this door frame to the wall advantageously eliminates the need for shims that are used to square prehung door frames.

It is, therefore, a primary object of the present invention to provide an improved interior wall system which is relatively easily and inexpensively assembled to provide an attractive wall which forms an effective sound barrier, is sturdy, and yet may be easily taken down or removed.

It is a further object of this invention to provide an interior wall system in which the space between opposing sides of the wall can be easily varied to accommodate wires and pipes that need to be concealed within the wall.

It is a further object of the present invention to provide an interior wall system that includes a novel system and method for constructing door and window frames.

These and other objects and features of the present invention will become more fully apparent from the following description and appended claims taken in conjunction with the accompanying drawings.

DETAILED DESCRIPTION OF THE PREFERRED EMBODIMENTS

Figure 1:
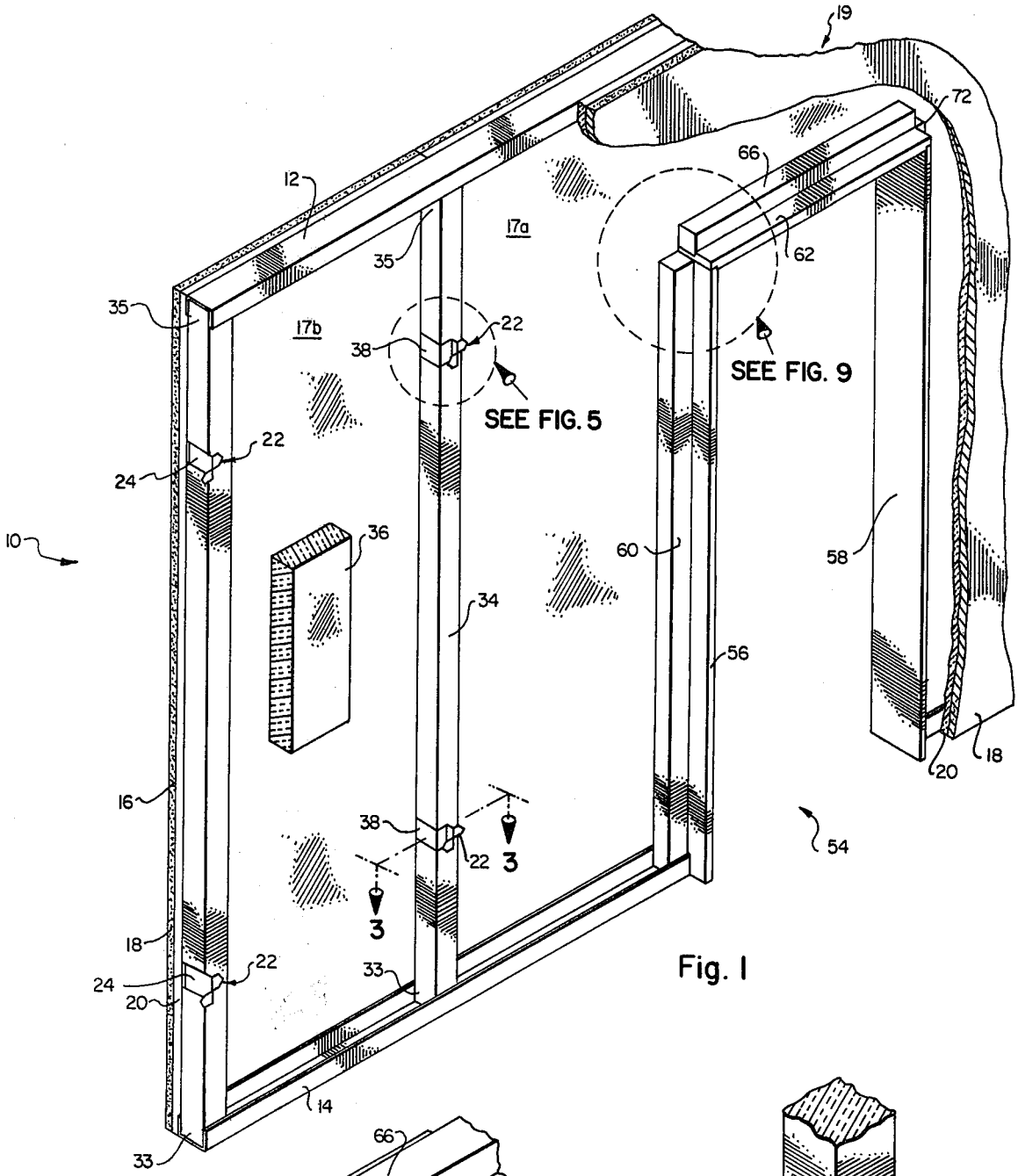
FIG. 1 is a fragmentary perspective view of one presently preferred embodiment of the interior wall system of the present invention.

Reference is now made to the drawing in which like parts are designated by like numerals throughout. As illustrated in FIG. 1, the interior wall system 10 comprises a bottom support member 14 in the form of a U-shaped metal channel. A corresponding top support member 12 in the form of a U-shaped metal channel is also provided. The support members 14 and 12 are securely anchored to the floor and ceiling structures (not shown), respectively, with screws or nails (not shown).

A first wall 16 is securely attached to support members 12 and 14 by inserting screws through wall panels 17 into support members 12 and 14. Additionally, glue can be used between the panels 17 and the support members 12 and 14 to more securely fasten them together. A second, opposing wall 19 is similarly constructed along the opposite sides of U channels 12 and 14.

Composite wall panels 17 of walls 16 and 19 each comprise an external surface material 18 onto which a layer of foamed plastic insulating material 20 is adhered. The external surface material 18 may be gypsum wall board or any other suitable material such as plywood, wall paneling or vinyl wall covering, depending upon the type of exterior wall surface desired. The layer of foamed plastic insulating material 20 may be polyurethane foam bonded directly to the back of the exterior surface material 20, as described in U.S. Pat. No. 4,037,006, incorporated herein by reference. Clearly any suitable type of insulating material such as polyurethane or polystyrene can be used.

Figure 4:
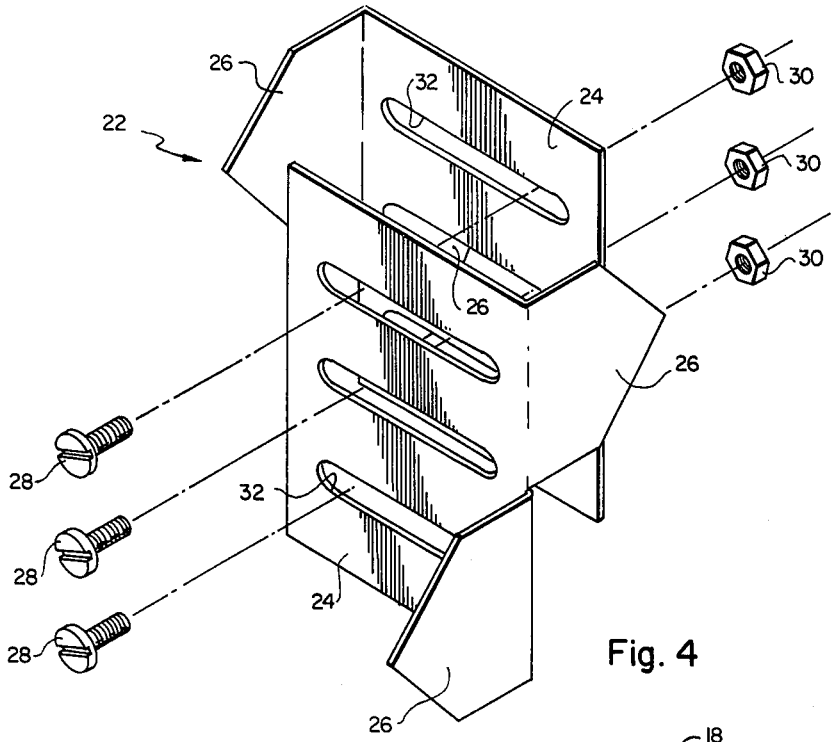
FIG. 4 is an exploded perspective view of the retaining clip shown in FIGS. 1, 2, 3 and 5.
Figure 3:
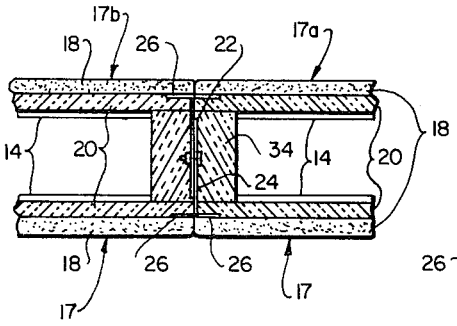
FIG. 3 is a horizontal cross-sectional view taken along line 3—3 of FIG. 1.
Figure 2:
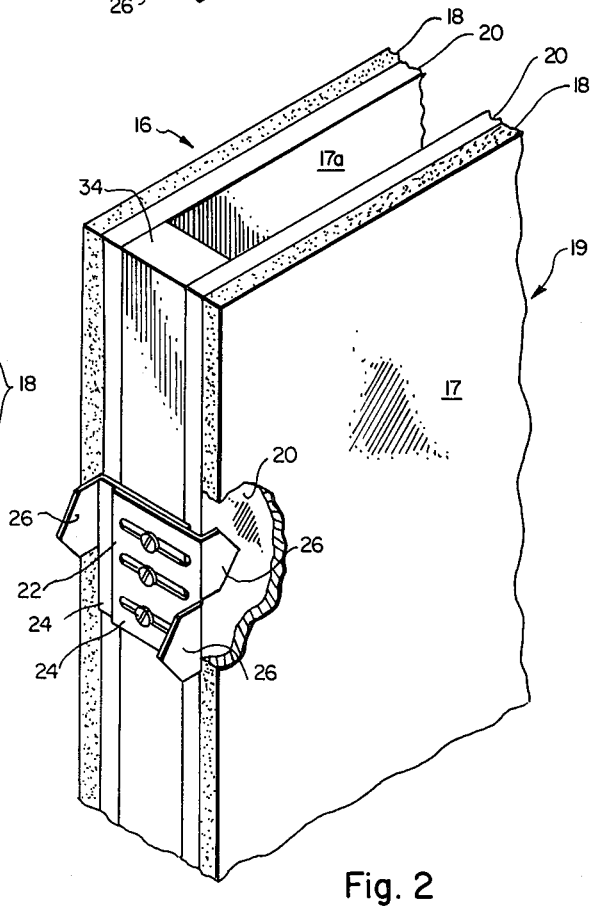
FIG. 2 is an enlarged perspective view of a portion of the present invention showing one presently preferred embodiment of the retaining clip used to connect adjoining and opposing wall panels.

Referring now to FIGS. 2–4, a retaining clip generally designated at 22 and having a connecting member 24 and flanges 26 is attached to the wall panel 17 (see FIG. 2) by inserting the flanges 26 between the external surface material 18 and the layer of foamed plastic insulating material 20 of each opposing wall 16 and 19. As shown best in FIG. 4, retaining clip 22 comprises two halves which are identically shaped. Each half has a connecting member 24 in the form of a web with a pair of flanges 26 extending laterally in opposite directions from one of the ends of the web. The connecting member 24 has slots 32 provided therein to acccommodate bolts 28. The two halves of retaining clip 22 are positioned such that connecting members 24 overlap each other with the flanges 26 of one half being on one end of the clip and flanges 26 of the other half being on the other end of the clip 22. Bolts 28 are then inserted through aligned slots 32 and are fastened by nuts 30. By having slots 32 in the connecting member 24, the length of the connecting member 24 can be adjusted by loosening nuts 30, and then sliding the connecting members 24 to increase or decrease the distance between the flanges 26 on opposite ends of the retaining clip 22.

This is highly advantageous because it allows the space between opposing walls 16 and 19 to be adjusted as necessary to fit pipes, wires or other structures which it may be desirable to enclose within the walls. It also permits the same clips to be used with wall panels of varying thicknesses. For example, in some applications it may be desirable to increase the thickness of the layer of foamed plastic insulating material 20 to increase the thermal insulating characteristics of the wall or to provide a more substantial sound barrier.

After flanges 26 of retaining clips 22 are inserted into a first wall panel 17*a* (see FIG. 3), an adjacent wall panel 17*b* is installed by positioning the wall panel flatwise against support members 12 and 14 and sliding the second wall panel 17*b* toward the first wall panel 17*a* until they abut each other. Exposed flanges 26 of retaining clips 22 are guided between the external surface material 18 and the layer of foamed plastic insulating material 20 of the second wall panel 17*b* as it is slid into position. The second wall panel 17*b* is then anchored to support members 12 and 14 with screws. Additional wall panels 17 are installed in a similar manner to complete the first opposing wall 16 (see FIGS. 1 and 2).

With reference again to FIG. 1, spline members 34 are next installed over the seams between adjacent wall panels 17*a* and 17*b*. Spline members 34 provide an effective barrier against light, dust and noise that can travel from one room to an adjoining room through the cracks between adjacent wall panels 17*a* and 17*b*. Spline members 34 are usually made from strips of foamed plastic insulating material. However, they can easily be made from other material such as gypsum board or wood. This is sometimes necessary if local fire regulations require a higher fire rating for the wall construction.

Figure 5:
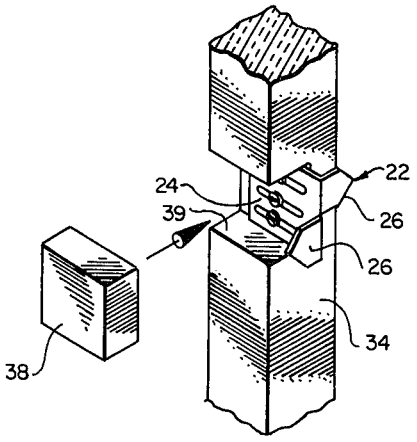
FIG. 5 is an enlarged perspective view showing a portion of the spline illustrated in FIG. 1 with the insert block of the spline removed to reveal the retaining clip.

As shown best in FIG. 5, a block 38 is cut out of spline 34 to form a notch 39. Notches 39 are necessary to allow spline 34 to slide over retaining clips 22. Spline 34 is positioned flatwise against the installed wall panels 17 with the bottom end 33 of spline 34 being positioned between the side flanges of U-shaped bottom support member 14 and the top end 35 of spline 34 being positioned between the side flanges of U-shaped top support member 12. Spline 34 is then slid laterally until notch 39 abuts connecting member 24 of retaining clip 22. Block 38 is then replaced and glued into notch 39. Not only does spline 34 provide a barrier to noise, dust and light, but it also adds strength to the overall wall construction.

It has also been found advantageous to use spacers 36 when wall panels 17 having widths greater than two feet are used. The spacers 36 provide additional lateral support to the wall panels 17 between the joints where retaining clips 22 are used. As illustrated in FIG. 1, spacer 36 comprises a block of material glued to the inner face of the layer of foamed plastic insulating material 20 on one side of the wall construction. Spacer 36 has a thickness equal to the width of the space between opposing wall panels 17. Spacer 36 can be made from foamed plastic insulating material, gypsum board, blocks of wood, or any other suitable material. Although illustrated as a block in FIG. 1, spacer 36 could also be either horizontal or vertical strips, depending upon available material, the amount of support required, and any features such as pipes or wires which must be enclosed inside the wall.

After splines 34 and spacers 36 are in place, wall 19 can be installed. A wall panel 17 is positioned adjacent top support member 12 and bottom support member 14 with the insulating material 20 being positioned toward the center of the wall system. Wall panel 17 is then slid laterally until flanges 26 of clips 22 are positioned between exterior surface 18 and insulating material 20. Additional wall panels 17 are then installed in a similar manner to form wall 19.

Figure 6:
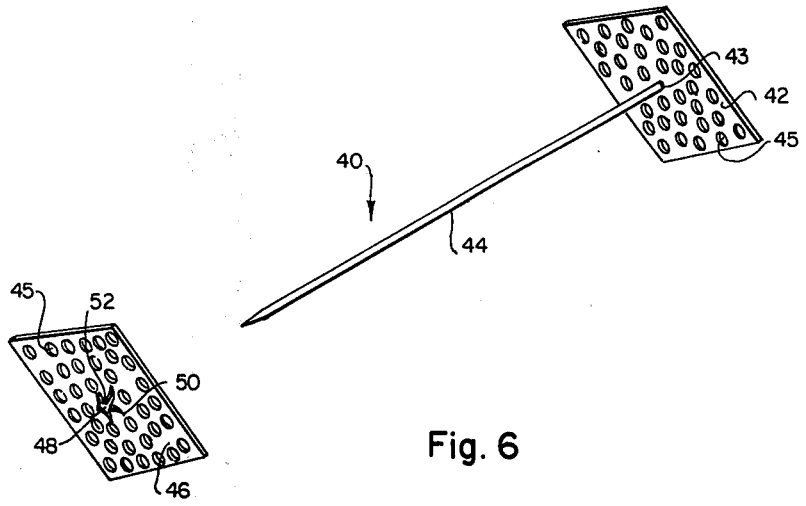
FIG. 6 is a perspective view of a second presently preferred embodiment of the retaining clip of the present invention.
Figure 8:
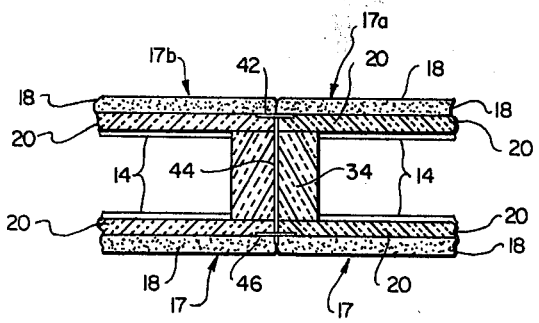
FIG. 8 is a horizontal cross-sectional view taken along line 8—8 of FIG. 7.
Figure 7:
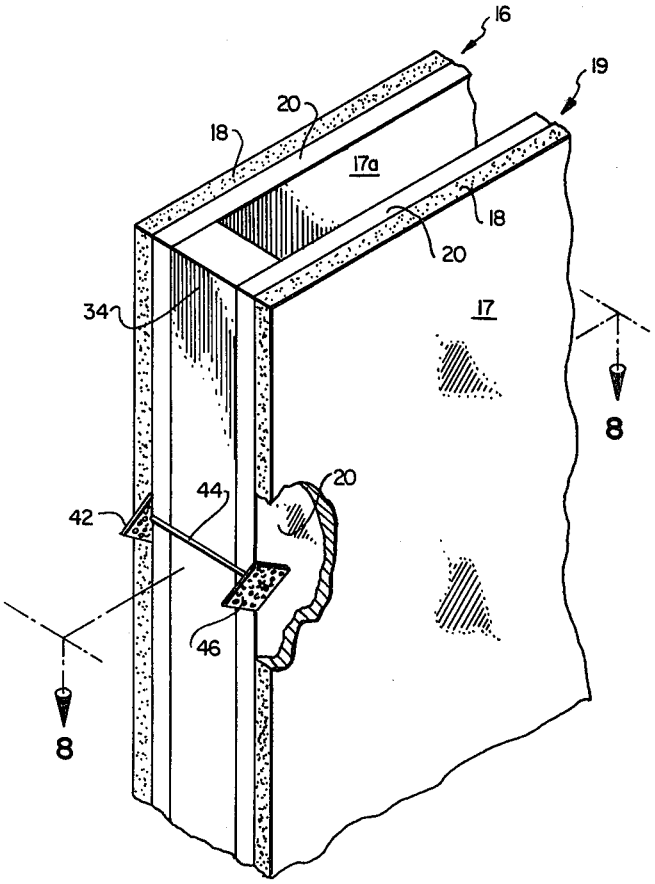
FIG. 7 is an enlarged perspective view of a portion of the present invention showing the retaining clip of FIG. 6 connecting opposing and adjoining wall panels.

Referring now to FIGS. 6–8, a second preferred embodiment of a retaining clip 40 is illustrated. Connecting member 44 in this embodiment is a metal spike such as long nail. In practice it has been found that a copper spike works better than a steel spike. A first flange 42 comprises a diamond-shaped piece of sheet metal. Spike 44 is positioned at the center of the first flange 42 and is anchored there by spotwelding or other suitable means.

A second diamond-shaped flange 46 is adapted to adjustably slide onto the other end of spike 44. The second flange 46 has a hole 48 in the center thereof. Slits 50 extend radially a short distance from hole 48. To attach the second flange 46 to spike 44, the end of spike 44 is inserted through hole 48. The diameter of hole 48 is slightly smaller than the diameter of spike 44. Therefore, as spike 44 passes through hole 48, projections 52 flare outwardly. The sharp points on the ends of projections 52 prevent the second flange 46 from sliding off spike 44 once it is positioned.

As shown in FIG. 7, one side of flange 42 is inserted between the external surface material 18 and foamed plastic insulating material 20 of a first wall panel 17*a*. A second wall panel 17*b* (see FIG. 8) is then positioned adjacent the first panel 17*a* with the other side of flange 42 being inserted between the external surface material 18 and the foamed plastic insulating material 20. If foamed plastic insulating material is used for spline 34, it can simply be pushed onto spike 44. If a more solid material is used for spline 34 such as gypsum board, a small hole can be drilled through the spline to accommodate spike 44.

After the spline 34 is positioned, the second flange 46 is positioned on spike 44. Spike 44 is normally long enough to accommodate the largest spacing that may be required between opposing wall panels 17. Therefore, if a narrower wall is desired, the excess length of spike 44 can be clipped off after the second flange 46 is positioned.

Wall panels 17 of wall 19 (see FIG. 7) can then be positioned and attached by placing them adjacent top and bottom support members 12 and 14 and spline 34 with the second flange 46 being inserted between the external surface material 18 and foamed plastic insulating material 20 of adjacent panels.

To more securely anchor retaining clip 40 in place, glue can be applied to flanges 42 and 46. In practice, it has been found advantageous to provide holes 45 in flanges 42 and 46. Glue penetrates holes 45 and more firmly affixes flanges 42 and 46 between the external surface material 18 and foamed plastic insulating material 20.

Figure 9:
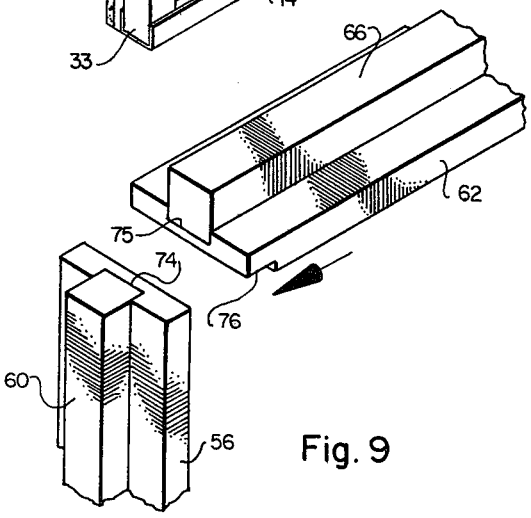
FIG. 9 is an exploded perspective view of a corner of the door frame of the present invention.

Referring now to FIGS. 1 and 9, a preferred embodiment of the door frame construction of the present invention is illustrated. Door frame 54 comprises two jamb members 56 and 58 and a lintel member 62. Jamb member 56 has a spacing member 60 attached to approximately the center of the jamb 56 (see also FIG. 9). Preferably, jamb 56 has a groove 74 into which spacing member 60 is glued, nailed, or similarly fastened. Jamb 56 has a width great enough to span the distance from the outer edge of wall panel 17 on wall 16 to the outer edge of the corresponding wall panel 17 on wall 19. Spacing member 60 is narrower in width than jamb 56 and is made to fit snugly in the space between opposing wall panels 17. The second jamb member 58 is identically constructed.

Lintel member 62 includes a spacing member 66. The width of lintel 62 is identical to the width of jambs 56 and 58. Spacing member 66 is preferrably anchored in a groove 75 (see FIG. 9) located in the top of lintel 62. The length of lintel 62 is equal to the width of the door opening plus the thickness of door jambs 56 and 58. Lintel 62 has a notch 76 on both ends thereof that fits over the top ends of door jambs 56 and 58.

Door frame 54 is installed by inserting spacing member 60 of the first jamb 56 between the opposing wall panels 17 of walls 16 and 19, forming one edge of the door opening. The back of jamb 56 should substantially abut against the edges of opposing wall panels 17. Jamb 56 is then vertically aligned and screws are inserted through the opposing wall panels 17 into spacing member 60 to hold jamb 56 rigidly in place.

Lintel 62 is installed next by inserting one end with a notch 76 above jamb 56. Notch 76 should be positioned directly above the top of jamb 56. Spacing member 66 is inserted between the opposing wall panels 17 of walls 16 and 19. After lintel 62 is squared with jamb 56, screws are inserted through wall panels 17 into spacing member 66 to securely anchor lintel 62 in place, forming the second side of the door frame.

Finally, the second jamb 58 is positioned. The top edge of jamb 58 is placed in the notch 76 in lintel 62. Spacing member 72 is inserted between the wall panels forming the second side of the door opening. When jamb 58 is squared with lintel 62, screws are inserted through wall panels 17 to anchor jamb 58 in place.

If desired, the system and method used in constructing the door frame 54 may also be used to construct window frames or other openings in the interior wall system.

The present invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An interior wall system comprising:

top and bottom support members;

first and second walls attached to said support members, each wall comprising a plurality of composite wall panels, and each composite wall panel comprising an exterior surface material and an interior insulating material bonded to one side of said exterior surface material; and a plurality of retaining clips interconnecting said first and second walls and also interconnecting the composite wall panels of each wall in abutting relationship, each said clip comprising two members which are selectively positionable with respect to each other, at least a portion of said members extending between said first and second walls, so as to provide means for adjusting the width between said first and second walls.

2. An interior wall system as defined in claim 1 wherein each said support member comprises a U-shaped metal channel.

3. An interior wall system as defined in claim 1 wherein the exterior surface material of said composite wall panel comprises rigid gypsum board, and wherein said interior insulating material comprises polyurethane foam.

4. An interior wall system as defined in claim 1 wherein said two members are configured as a first web member perpendicularly attached to a first pair of flanges and a second web member perpendicularly attached to a second pair of flanges, said clip comprising means for adjustably securing said first web member to said second web member.

5. An interior wall system as defined in claim 1 further comprising a door frame, said door frame comprising a first jamb member having a spacing member, a lintel member having a spacing member, and a second jamb member having a spacing member, each said jamb member having a groove on one side thereof within which the respective spacing members are securely anchored.

6. An interior wall system as defined in claim 1 further comprising a plurality of spline members vertically positioned between said first and second walls at the seams between adjoining composite wall panels, each said spline member extending from said top support member to said bottom support member.

7. An interior wall system as defined in claim 1 further comprising a plurality of spacers inserted between said first and second walls.

8. An interior wall system comprising:

top and bottom support members, the bottom support member being secured and fastened to a floor and the top support member being securely fastened to a ceiling structure;

first and second walls attached to said support members, each wall comprising a plurality of composite wall panels, and each composite wall panel comprising an exterior surface material backed by a layer of foamed plastic insulating material adhered thereto;

a plurality of spline members vertically positioned between said first and second walls at the seams between adjoining composite wall panels; and a plurality of retaining clips interconnecting said first and second walls and also interconnecting the composite wall panels of each wall in abutting relationship, each said clip comprising two members which are selectively positionable with respect to each other, at least portion of said members extending between said first and second walls so as to provide means for adjusting the width between said first and second walls, and each said clip extending from one said wall through one of said spline members to the other said wall.

9. An interior wall system as defined in claim 8 wherein each said support member comprises a U-shaped metal channel.

10. An interior wall system as defined in claim 8 wherein the exterior surface material of said composite wall panels comprises rigid gypsum board, and wherein said insulating material comprises polyurethane foam.

11. An interior wall system as defined in claim 8 wherein said splines are constructed from polyurethane foam.

12. An interior wall system as defined in claim 8 wherein said two member are configured as a first web member perpendicularly attached to a first pair of flanges and a second web member perpendicularly attached to a second pair of flanges, said clip comprising means for adjustably securing said first web member to said second web member, the first and second web members extending through said splines and the first pair of flanges being attached to adjoining wall panels of said first wall and the second pair of flanges being attached to adjoining wall panels of said second wall.

13. An interior wall system as defined in claim 8 further comprising a door frame, said door frame comprising a first jamb member having a spacing member, a lintel member having a spacing member, and a second jamb member having a spacing member, each said facing member having a groove on one side thereof within which the respective spacing members are securely anchored.

14. An interior wall system as defined in claim 8 further comprising a plurality of spacers inserted between said first and second walls.

* * * * *

UNITED STATES PATENT AND TRADEMARK OFFICE

CERTIFICATE OF CORRECTION

PATENT NO. : 4,418,507

DATED : December 6, 1983

INVENTOR(S) : Frank W. Roberts et al.

It is certified that error appears in the above—identified patent and that said Letters Patent is hereby corrected as shown below:

In column 2, line 21, change "are" to --being --

In column 5, line 37, after the word "as" insert -- a --

In column 6, line 35, change "preferrably" to -- preferably --

In column 8, line 20, after the word "least" insert -- a --

In column 8, line 37, change "member" to -- members --

Signed and Sealed this

*Thirty-first* Day of *July 1984*

[SEAL]

*Attest:*

GERALD J. MOSSINGHOFF

*Attesting Officer*

*Commissioner of Patents and Trademarks*